US009426579B2

(12) United States Patent
Kang et al.

(10) Patent No.: US 9,426,579 B2
(45) Date of Patent: Aug. 23, 2016

(54) ELECTRO-ACOUSTIC TRANSDUCER

(71) Applicant: SAMSUNG ELECTRONICS CO., LTD., Suwon-si (KR)

(72) Inventors: Sung-chan Kang, Hwaseong-si (KR); Dong-kyun Kim, Suwon-si (KR); Sang-ha Park, Seoul (KR); Jong-seok Kim, Hwaseong-si (KR); Yong-seop Yoon, Seoul (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 14/312,853

(22) Filed: Jun. 24, 2014

(65) Prior Publication Data

US 2015/0215705 A1 Jul. 30, 2015

(30) Foreign Application Priority Data

Jan. 29, 2014 (KR) ..... 10-2014-0011738

(51) Int. Cl.
*H04R 17/00* (2006.01)
*B06B 1/02* (2006.01)

(52) U.S. Cl.
CPC ..... *H04R 17/00* (2013.01); *B06B 1/0292* (2013.01)

(58) Field of Classification Search
CPC ..... H04R 1/08; H04R 9/08; H04R 11/04; H04R 17/02; H04R 21/02; H04R 19/04; H04R 19/005
USPC ..... 381/170, 174–176, 369; 257/419
See application file for complete search history.

(56) References Cited

U.S. PATENT DOCUMENTS

| | | | | |
|---|---|---|---|---|
| 5,870,351 | A | 2/1999 | Ladabaum et al. | |
| 6,377,695 | B1 * | 4/2002 | Azima | B60R 11/0217 381/152 |
| 7,596,235 | B2 * | 9/2009 | Michiels | H04R 17/00 381/152 |
| 7,615,834 | B2 | 11/2009 | Khuri-Yakub et al. | |
| 8,477,983 | B2 * | 7/2013 | Weigold | H04R 1/406 381/174 |
| 2007/0215964 | A1 | 9/2007 | Khuri-Yakub et al. | |
| 2010/0268058 | A1 | 10/2010 | Chen | |
| 2014/0010052 | A1 | 1/2014 | Torashima et al. | |

FOREIGN PATENT DOCUMENTS

| | | | |
|---|---|---|---|
| EP | 1 764 162 | A1 | 3/2007 |
| JP | 4294798 | B2 | 7/2009 |
| JP | 2012-165308 | A | 8/2012 |
| JP | 5019997 | A | 9/2012 |

OTHER PUBLICATIONS

Communication dated Nov. 17, 2015 issued by the European Patent Office in counterpart European Patent Application No. 14178358.9.
Shiwei Zhou, et al; "Improving the Performance of Capacitive Micromachined Ultrasound Transducers using Modified Membrane and Support Structures"; IEEE Ultrasonics Symposium; Sep. 18, 2005; vol. 4; XP010899171; pp. 1925-1928.

* cited by examiner

*Primary Examiner* — Suhan Ni
(74) *Attorney, Agent, or Firm* — Sughrue Mion, PLLC

(57) ABSTRACT

An electro-acoustic transducer includes a plurality of elements, in which each of the plurality of elements includes a plurality of cells, of which at least one of the plurality of cells includes a trench that is formed in a membrane.

20 Claims, 11 Drawing Sheets

ELECTRO-ACOUSTIC TRANSDUCER

RELATED APPLICATIONS

This application claims priority from Korean Patent Application No. 10-2014-0011738, filed on Jan. 29, 2014, in the Korean Intellectual Property Office, the disclosure of which is incorporated herein by reference in its entirety.

BACKGROUND

1. Field

Exemplary embodiments relate to an electro-acoustic transducer, and more particularly, to a micromachined electro-acoustic transducer.

2. Description of the Related Art

Electro-acoustic transducers are devices that convert electric energy to acoustic energy or vice versa and may include ultrasonic transducers and microphones. Micromachined electro-acoustic transducers are transducers that use a micro-electro-mechanical system (MEMS). A typical example of a micromachined electro-acoustic transducer is a micromachined ultrasonic transducer (MUT), which is a device that converts an electric signal to an ultrasonic signal or vice versa. An MUT may be classified into a piezoelectric MUT (pMUT), a capacitive MUT (cMUT), and a magnetic MUT (mMUT), based on its converting method.

A pMUT has been mainly used in the past. Recently, the cMUT is increasingly under development because of its merits, such as a capability of transmitting/receiving a broadband signal, a conduciveness to mass production using a semiconductor process, and a capability of integration with an electric circuit. Accordingly, a cMUT is widely used in medical image diagnosis devices or sensors.

Recently, as a demand for various types of ultrasound signal acquisition methods and resulting images such as a B-mode image, a Doppler image, a harmonic image, and a photoacoustic image, which are obtainable for use in an ultrasound diagnosis, increases, ultrasound equipment having broadband characteristics is increasingly under development. Further, on order to cover diagnosis of various organs having different sizes and depths such as the abdomen, the heart, and the thyroid gland, the development of ultrasound equipment having a broadband characteristic is essential. Compared to a general piezoelectric ultrasonic transducer, although a cMUT is capable of transceiving broadband signals, it has a limit in receiving the overall frequency band. Accordingly, methods of embodying broadband by combining cells having different resonant frequencies are being developed.

SUMMARY

Provided is a micromachined electro-acoustic transducer.

Additional aspects will be set forth in part in the description which follows and, in part, will be apparent from the description, or may be learned by practice of the presented exemplary embodiments.

According to an aspect of one or more exemplary embodiments, an electro-acoustic transducer includes a plurality of elements, in which each of the plurality of elements includes a plurality of cells of which at least one of the plurality of cells includes a trench that is formed in a membrane.

Each of the plurality of elements may include a first frequency band that is wider than a respective frequency band of each of the plurality of cells constituting the respective element.

For each of the plurality of elements, a frequency characteristic of the at least one of the plurality of cells that includes the trench may vary based on at least one from among a number, a shape, a size, and a position of the trench.

For each of the plurality of elements, at least two cells of the plurality of cells may include different numbers of trenches.

For each of the plurality of elements, a plane shape of the trench may include at least one from among a circle and a polygon.

For each of the plurality of elements, a sectional shape of the trench may include at least one from among a rectangle, a triangle, and a semicircle.

For each of the plurality of elements, the membrane may include silicon.

Each of the plurality of elements and each of the pluralities of cells may be arranged in a respective two-dimensional arrangement.

For each of the plurality of elements, each of plurality of cells may have a same size.

Each of the plurality of cells may include a substrate, a support provided on the substrate and comprising a cavity, the membrane configured to cover the cavity, and an electrode provided on an upper surface of the membrane.

According to another aspect of one or more exemplary embodiments, an element of an electro-acoustic transducer includes a plurality of cells comprising a first cell and a second cell, wherein each of the first cell and the second cell has a same size and a frequency characteristic of the first cell is different from a frequency characteristic of the second cell.

Each of the first cell and the second cell may include a respective membrane, and at least one from among the first cell and the second cell may include a trench that is formed in at least one from among an upper surface and a lower surface of the corresponding membrane.

According to another aspect of one or more exemplary embodiments, an electro-acoustic transducer includes a plurality of elements, in which each of the plurality of elements includes a plurality of cells, wherein for each of the plurality of elements, each of the plurality of cells includes a substrate, a support provided on the substrate and comprising a cavity, a membrane configured to cover the cavity, and an electrode provided on an upper surface of the membrane, and wherein, for each of the plurality of elements, at least one of the plurality of cells includes a trench that is formed in the membrane.

BRIEF DESCRIPTION OF THE DRAWINGS

These and/or other aspects will become apparent and more readily appreciated from the following description of exemplary embodiments, taken in conjunction with the accompanying drawings in which.

DETAILED DESCRIPTION

Figure 1:
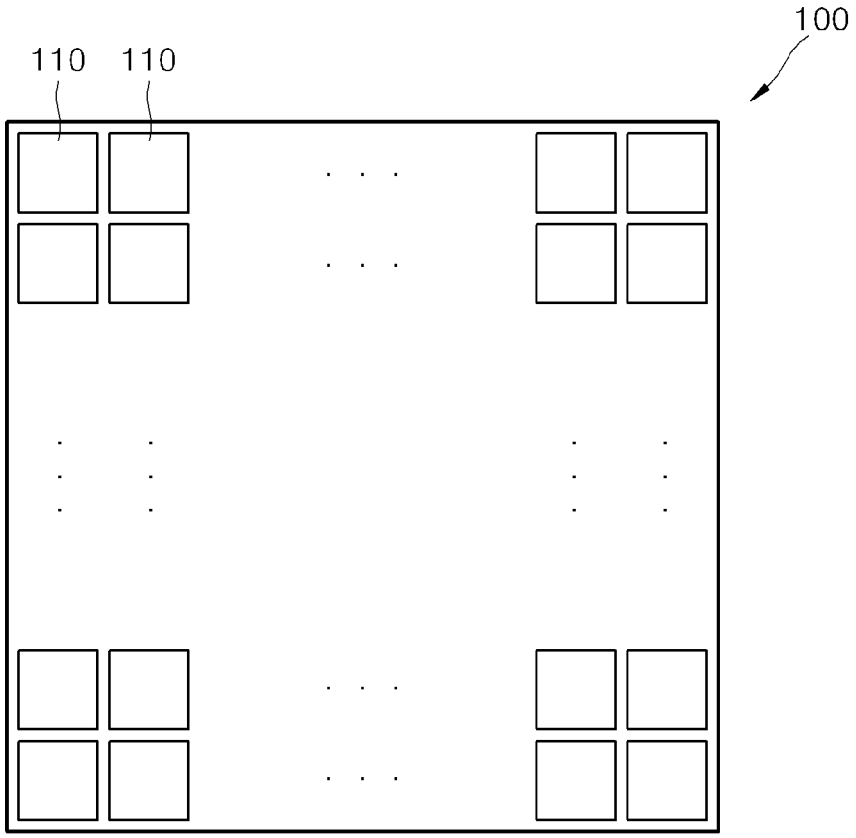
FIG. 1 is a plan view of a transducer chip of an electro-acoustic transducer, according to an exemplary embodiment.

Reference will now be made in detail to exemplary embodiments, examples of which are illustrated in the accompanying drawings, wherein like reference numerals refer to like elements throughout. In this regard, the present exemplary embodiments may have different forms and should not be construed as being limited to the descriptions set forth herein. Accordingly, the exemplary embodiments are merely described below, by referring to the figures, to explain aspects of the present disclosure. Also, the thickness or size of each layer illustrated in the drawings may be exaggerated for convenience of explanation and clarity. In the following description, when a layer is described to exist on another layer, the layer may exist directly on the other layer or a third layer may be interposed therebetween. A material forming each layer in the following exemplary embodiments is merely exemplary and thus other material may be used therefor.

As used herein, expressions such as "at least one of," when preceding a list of elements, modify the entire list of elements and do not modify the individual elements of the list.

FIG. 1 is a plan view of a transducer chip 100 of an electro-acoustic transducer, according to an exemplary embodiment. The electro-acoustic transducer may include a plurality of transducer chips 100. FIG. 1 illustrates one of the transducers chips 100 which constitutes an electro-acoustic transducer. The electro-acoustic transducer may be a capacitive micromachined electro-acoustic transducer, such as, for example, a capacitive micromachined ultrasonic transducer (cMUT). Referring to FIG. 1, the transducer chip 100 of the electro-acoustic transducer may include a plurality of elements 110 that are arranged in a two-dimensional arrangement. The elements 110 may be independently driven. Each of the elements 110 includes a plurality of cells 111 that are arranged in a respective two-dimensional arrangement, as described below.

Figure 2:
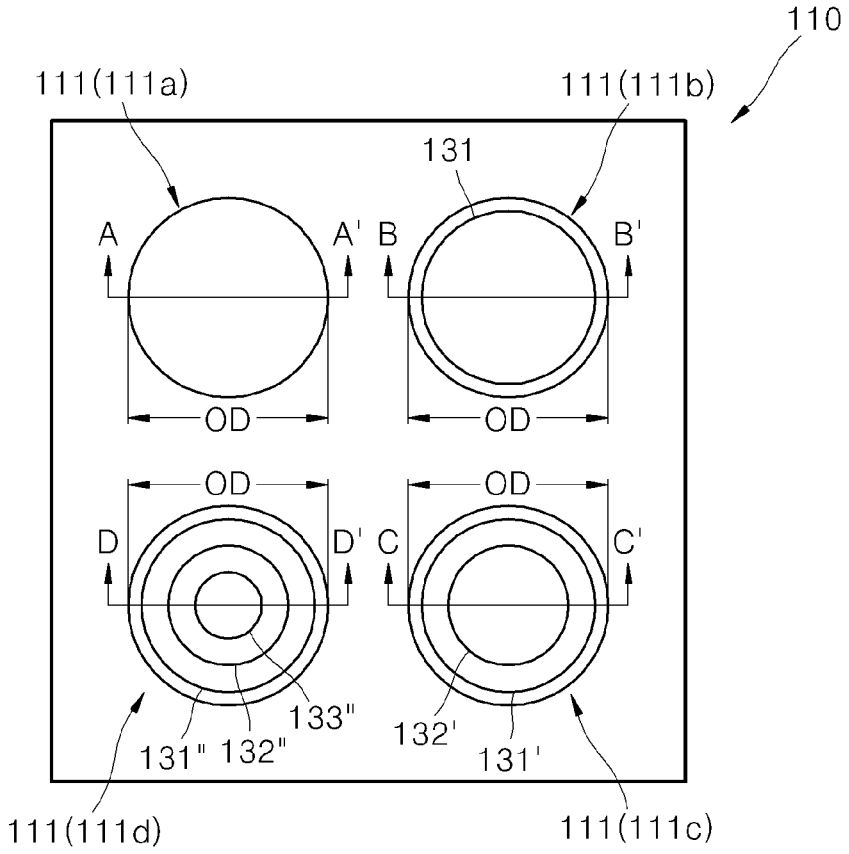
FIG. 2 is a plan view of an element illustrated in FIG. 1.

FIG. 2 is a plan view of one of the elements 110 illustrated in FIG. 1. Referring to FIG. 2, the element 110 includes the cells 111 that are arranged in a two-dimensional arrangement. In detail, the cells 111 may include four cells which are arranged in a rectangular shape, that is, first, second, third, and fourth cells 111*a*, 111*b*, 111*c*, and 111*d*. FIG. 2 illustrates an example in which the first, second, third, and fourth cells 111*a*, 111*b*, 111*c*, and 111*d* are arranged in a clockwise order. In addition, the first, second, third, and fourth cells 111*a*, 111*b*, 111*c*, and 111*d* may be arranged in any one or more of a variety of shapes. The first, second, third, and fourth cells 111*a*, 111*b*, 111*c*, and 111*d* may have a same size. That is, when each of the first, second, third, and fourth cells 111*a*, 111*b*, 111*c*, and 111*d* has a circular structure, the first, second, third, and fourth cells 111*a*, 111*b*, 111*c*, and 111*d* may have a same outer diameter (OD). Membranes 115 of FIGS. 3A, 3B, 3C, and 3D forming the first, second, third, and fourth cells 111*a*, 111*b*, 111*c*, and 111*d* may have a same OD and a same thickness t. However, the present exemplary embodiment is not limited thereto. The first, second, third, and fourth cells 111*a*, 111*b*, 111*c*, and 111*d* may have different frequency characteristics, that is, different resonant frequencies. As described below, the first, second, third, and fourth cells 111*a*, 111*b*, 111*c*, and 111*d* may have different numbers of trenches, so that the first, second, third, and fourth cells 111*a*, 111*b*, 111*c*, and 111*d* may have different resonant frequencies.

Figure 3A:
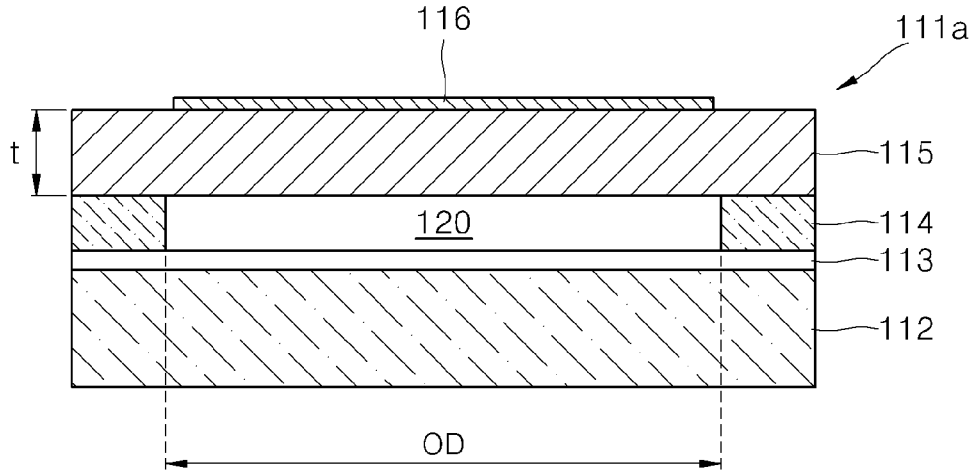
FIG. 3A is a cross-sectional view taken along line A-A' of FIG. 2.
Figure 3B:
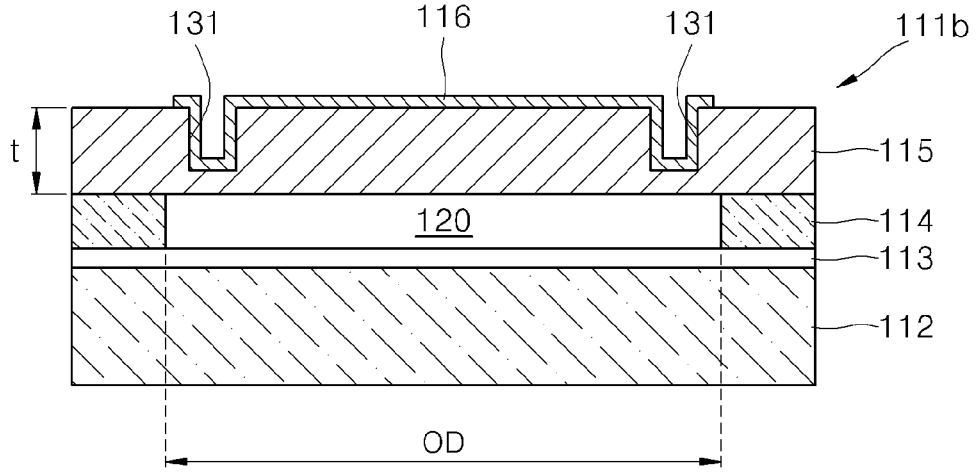
FIG. 3B is a cross-sectional view taken along line B-B' of FIG. 2.
Figure 3C:
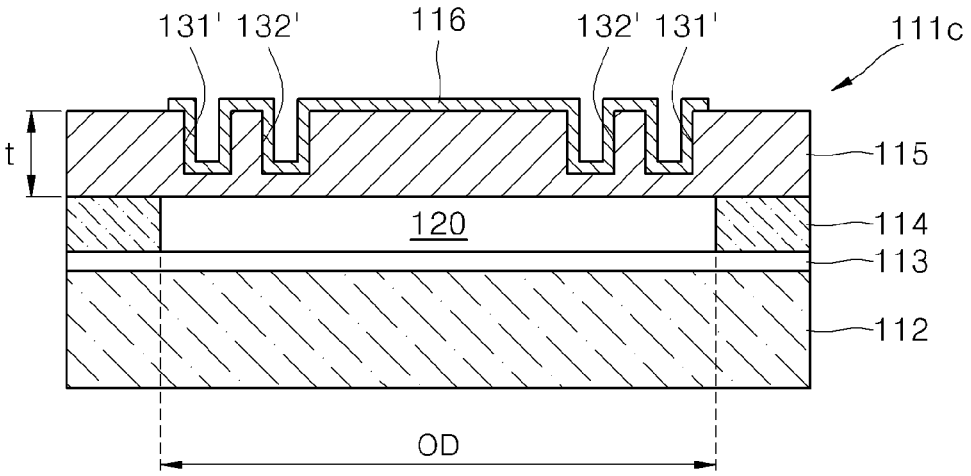
FIG. 3C is a cross-sectional view taken along line C-C' of FIG. 2.
Figure 3D:
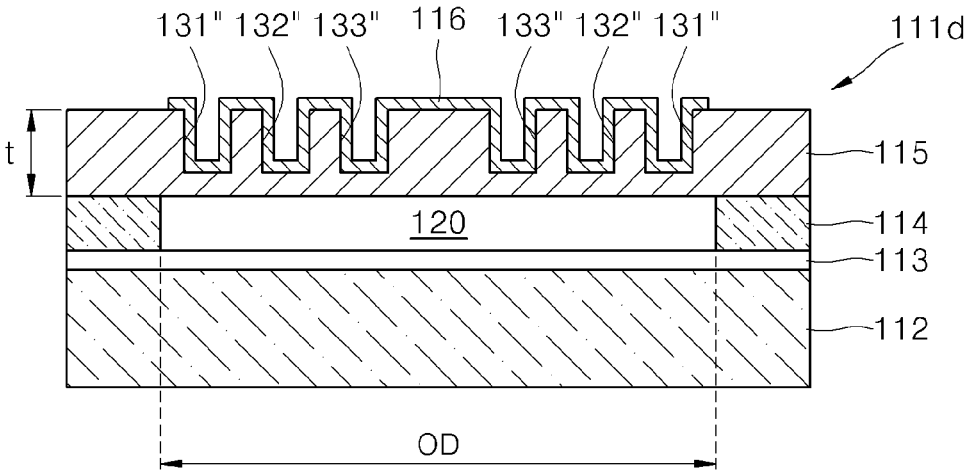
FIG. 3D is a cross-sectional view taken along line D-D' of FIG. 2.

FIGS. 3A, 3B, 3C, and 3D are cross-sectional views of the four cells, namely, the first, second, third, and fourth cells 111*a*, 111*b*, 111*c*, and 111*d*, which constitute the element 110. In detail, FIG. 3A is a cross-sectional view taken along line A-A' of FIG. 2, illustrating the first cell 111*a*. FIG. 3B is a cross-sectional view taken along line B-B' of FIG. 2, illustrating the second cell 111*b*. FIG. 3C is a cross-sectional view taken along line C-C' of FIG. 2, illustrating the third cell 111*c*. FIG. 3D is a cross-sectional view taken along line D-D' of FIG. 2, illustrating the fourth cell 111*d*.

Referring to FIGS. 3A, 3B, 3C, and 3D, each of the first, second, third, and fourth cells 111*a*, 111*b*, 111*c*, and 111*d* includes a substrate 112, a support 114 provided on the substrate 112, the membrane 115 provided on the support 114, and an electrode 116 provided on the membrane 115. The substrate 112 may function as a lower electrode. To this end, the substrate 112 may include a conductive material. For example, although the substrate 112 may include low-resistance silicon, the present exemplary embodiment is not limited thereto. An insulation layer 113 formed of, for example, silicon oxide, may be further formed on an upper surface of the substrate 112. The support 114 is provided on the insulation layer 113, and a cavity 120 is formed therein. Although the support 114 may include, for example, silicon oxide, the present exemplary embodiment is not limited thereto. The membrane 115 is provided on the support 114 to cover the cavity 120. The membrane 115 may include, though the present exemplary embodiment is not limited thereto, for example, silicon. The electrode 116 is provided on an upper surface of the membrane 115. The electrode 116 functions as an upper electrode and may include, though the present exemplary embodiment is not limited thereto, for example, a metal.

The first, second, third, and fourth cells 111*a*, 111*b*, 111*c*, and 111*d* which constitute the element 110 may include different numbers of trenches. In detail, referring to FIGS. 2 and 3A, in the first cell 111*a* of the cells 111 constituting the element 110, no trench is formed in the membrane 115. Referring to FIGS. 2 and 3B, among the cells 111 constituting the element 110, in the second cell 111*b*, one trench 131 is formed in an upper surface of the membrane 115. The trench 131 may be formed, for example, circularly in the upper surface of the membrane 115 (as illustrated in FIG. 2), and a sectional shape of the trench 131 may be rectangular (as illustrated in FIG. 3B). The plane shape and the sectional shape of the trench 131 may be variously modified.

Referring to FIGS. 2 and 3C, in the third cell 111*c* of the cells 111 constituting the element 110, two trenches, that is, first and second trenches 131' and 132', are formed in the upper surface of the membrane 115. The first and second trenches 131' and 132' may be formed, for example, circularly in the upper surface of the membrane 115, and separate from each other (as illustrated in FIG. 2). The sectional shape of each of the first and second trenches 131' and 132' may be rectangular (as illustrated in FIG. 3C). The plane shape and the sectional shape of each of the first and second trenches 131' and 132' may be variously modified. Referring to FIGS. 2 and 3D, in the fourth cell 111*d* of the cells 111 constituting the element 110, three trenches, that is, first, second, and third trenches 131", 132", and 133", are formed in the upper surface of the membrane 115. The first, second, and third trenches 131", 132", and 133" may be formed, for example, circularly in the upper surface of the membrane 115, and separate from one another (as illustrated in FIG. 2). The sectional shape of each of the first, second, and third trenches 131", 132", and 133" may be rectangular (as illustrated in FIG. 3D). The plane shape and the sectional shape of each of the first, second, and third trenches 131", 132", and 133" may be variously modified. Conversely, the respective intervals between the first, second, and third trenches 131", 132", and 133" may be constant or irregular. The sectional shapes of the first, second, and third trenches 131", 132", and 133" may be identical to or different from one another.

The first cell 111*a* has no trenches. The second cell 111*b* includes one trench 131 formed in the membrane 115. The third cell 111*c* includes two trenches, that is, the first and second trenches 131' and 132', formed in the membrane 115. The fourth cell 111*d* includes three trenches, that is, the first, second, and third trenches 131", 132", and 133", formed in the membrane 115. As such, because the first, second, third, and fourth cells 111*a*, 111*b*, 111*c*, and 111*d* constituting the element 110 include different numbers of trenches 131, 131', 132', 131", 132", and 133", the first, second, third, and fourth cells 111*a*, 111*b*, 111*c*, and 111*d* may have different frequency characteristics, in detail, different resonant frequencies. Because one element is manufactured by combining the four cells, namely, the first, second, third, and fourth cells 111*a*, 111*b*, 111*c*, and 111*d*, having different resonant frequencies, a frequency band which is wider than a respective frequency band of each of the four cells, namely, the first, second, third, and fourth cells 111*a*, 111*b*, 111*c*, and 111*d*, may be embodied.

In general, a resonant frequency $f_r$ of a cell in a cMUT is expressible by Equation 1.

$$f_r = \frac{1}{2\pi}\sqrt{\frac{k}{m_e}} \cong \frac{2t_m}{\pi a^2}\sqrt{\frac{E+T}{1.8\rho(1-\nu^2)}} \quad \text{[Equation 1]}$$

In Equation 1, "k" and "$m_e$" denote a strength of a membrane and a mass of the membrane, respectively, and "$t_m$" and "a" denote a thickness of the membrane and a radius of the membrane, respectively. The radius "a" signifies one-half of the OD. "T", "E", "v", and "ρ" denote an internal stress, a Young's modulus, a Poisson ratio, and a density of the membrane, respectively.

Referring to Equation 1, it may be seen that a resonant frequency of a cell may be changed by varying the thickness "$t_m$" or the radius "a" of the membrane. Accordingly, one element which has broadband characteristics may be manufactured by combining cells having different resonant frequencies that are manufactured by varying the thickness or radius of the membrane. However, in this case, it may be difficult to make various thicknesses of the membrane and, when cells have different sizes (i.e., different outer diameters), it may be difficult to arrange cells densely or in two dimensions. In the present exemplary embodiment, by varying the number of trenches 131, 131', 132', 131", 132", and 133" formed in the membrane 115, the four cells, namely, the first, second, third, and fourth cells 111*a*, 111*b*, 111*c*, and 111*d*, which have different respective resonant frequencies are manufactured. By combining the four cells, namely, the first, second, third, and fourth cells 111*a*, 111*b*, 111*c*, and 111*d*, the element 110 having a broadband frequency characteristic may be embodied. In particular, when different numbers of trenches 131, 131', 132', 131", 132", and 133" are formed in the membrane 115, the strength "k" and the mass "$m_e$" of the membrane 115 in Equation 1 are changed. Accordingly, the four cells, namely, the first, second, third, and fourth cells 111*a*, 111*b*, 111*c*, and 111*d*, having different resonant frequencies may be manufactured.

Figure 4:
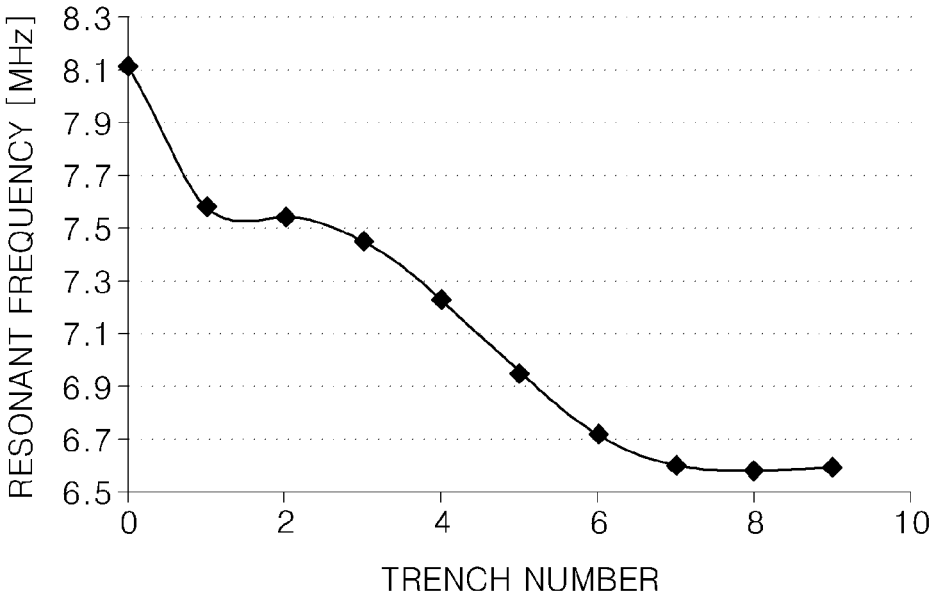
FIG. 4 is a graph which illustrates a result of a simulation of resonant frequencies which are calculated based on a number of trenches formed in a membrane of a cMUT.

FIG. 4 is a graph which illustrates a result of a simulation of resonant frequencies calculated based on the number of trenches formed in a membrane of a cMUT. In FIG. 4, a silicon membrane having a radius, that is, one-half of the OD, of about 21 μm and a thickness of about 0.9 μm is used as the membrane. The trench is formed to a depth of about 0.5 μm and a width of about 1 μm in the upper surface of the membrane. Referring to FIG. 4, the resonant frequency of a cell that does not include a trench is approximately equal to 8 MHz. It may be seen that, as the number of trenches formed in the membrane increases, the resonant frequency decreases to about 6.5 MHz.

Figure 5:
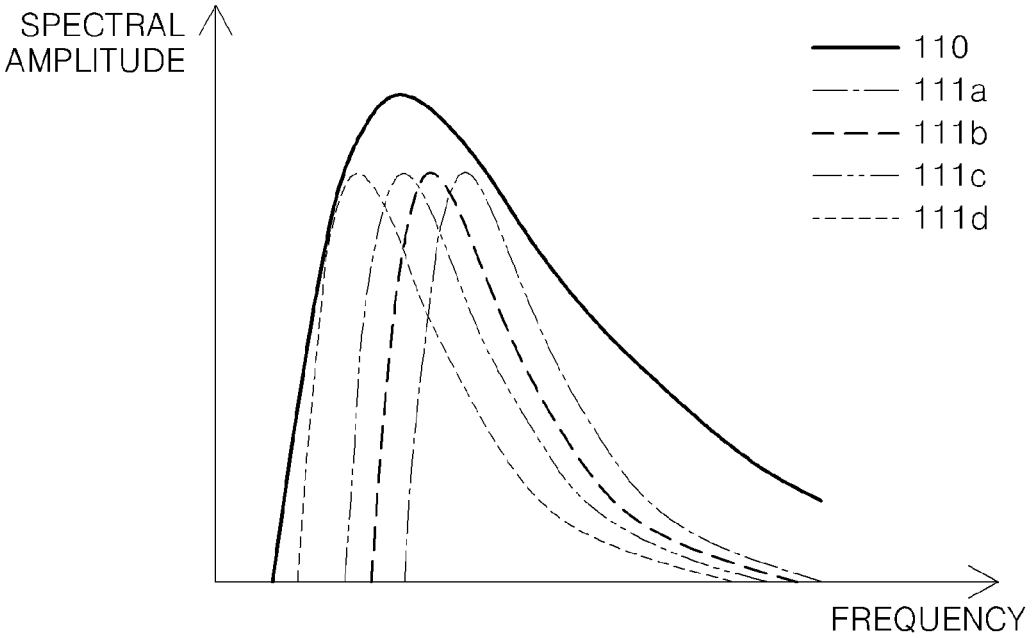
FIG. 5 is a graph which illustrates a frequency characteristic of the element embodied by combining cells having different resonant frequencies illustrated in FIG. 2.

FIG. 5 is a graph which illustrates a frequency characteristic of the element 110 embodied by combining the four cells, namely, the first, second, third, and fourth cells 111*a*, 111*b*, 111*c*, and 111*d*, which have different respective resonant frequencies and are illustrated in FIG. 2. Referring to FIG. 5, among the cells 111 constituting the element 110, the first cell 111*a* having no trenches has the highest resonant frequency, compared to the other cells, namely, the second, third, and fourth cells 111*b*, 111*c*, and 111*d*. The resonant frequencies of the cells, namely, the second, third, and fourth cells 111*b*, 111*c*, and 111*d*, which have the trenches 131, 131', 132', 131", 132", and 133", decrease as the number of trenches 131, 131', 132', 131", 132", and 133" increases. In particular, it may be seen that, among the cells 111 constituting the element 110, the resonant frequency of the fourth cell 111*d* that has the largest number of trenches, namely, the first, second, and third trenches 131", 132", and 133", is the lowest resonant frequency as compared to the resonant frequencies of the other cells, namely, the first, second, and third cells 111*a*, 111*b*, and 111*c*, which have different respective resonant frequencies. As such, when one element 110 is manufactured by combining the four cells, namely, the first, second, third, and fourth cells 111*a*, 111*b*, 111*c*, and 111*d*, having different resonant frequencies, the ranges of frequencies output from the four cells, namely, the first, second, third, and fourth cells 111*a*, 111*b*, 111*c*, and 111*d*, overlap one another, and thus, the element 110 may have a broadband frequency characteristic that is wider than the individual frequency band which is output from each of the four cells, namely, the first, second, third, and fourth cells 111*a*, 111*b*, 111*c*, and 111*d*. In a detailed example, when the first cell 111*a* has a resonant frequency of about 8.0 MHz and a bandwidth of about 5~11 MHz, the second cell 111*b* has a resonant frequency of about 7.5 MHz and a bandwidth of about 4.5~10.5 MHz, the third cell 111*c* has a resonant frequency of about 7.0 MHz and a bandwidth of about 4~10 MHz, and the fourth cell 111*d* has a resonant frequency of about 6.5 MHz and a bandwidth of about 3.5~9.5 MHz, the element 110 manufactured by combing the four cells, namely, the first, second, third, and fourth cells 111*a*, 111*b*, 111*c*, and 111*d*, may have a broadband frequency characteristic, that is, a bandwidth of about 3.5~11 MHz.

In the above exemplary embodiment, all the cells 111 constituting the element 110 are described to include different numbers of trenches 131, 131', 132', 131", 132", and 133". However, the present exemplary embodiment is not limited thereto, and some of the cells 111 may not include a trench, or may include a same number of trenches as others of the cells 111. In particular, at least one of the cells 111 may include a trench. In this case, at least two cells of the cells 111 may include different numbers of trenches. Further, in the above description, the cells 111 are described to have different frequency characteristics based on the respective number of trenches 131, 131', 132', 131", 132", and 133" formed in the membrane 111. However, the frequency characteristics of the cells 111 may vary not only based on the number of trenches 131, 131', 132', 131", 132", and 133" but also based on any one or more of the shape, the size, and/or the position of the trenches 131, 131', 132', 131", 132", and 133". In detail, the cells 111 may have different frequency characteristics based on at least one of the number, shape, size, and position of the trenches 131, 131', 132', 131", 132", and 133" formed in the membrane 115.

Figure 6A:
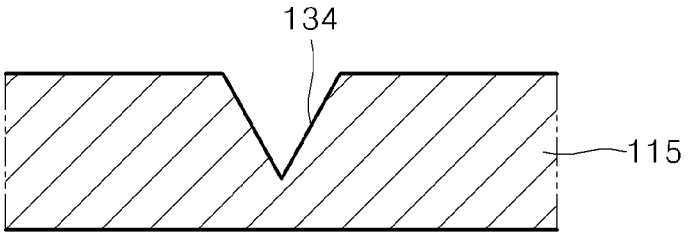
FIGS. 6A and 6B are sectional views which illustrate modified sectional shapes of the trench formed in the membrane.
Figure 6B:
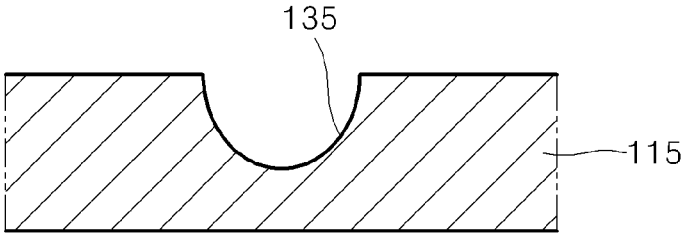

FIGS. 3B, 3C, and 3D illustrate that each of the trenches 131, 131', 132', 131", 132", and 133" formed in the membrane 115 has a rectangular sectional shape. However, the present exemplary embodiment is not limited thereto, and the trenches 131, 131', 132', 131", 132", and 133" may have any one or more of various sectional shapes. The frequency characteristic may vary based on the sectional shape of the trenches 131, 131', 132', 131", 132", and 133". FIGS. 6A and 6B illustrate modified sectional shapes of trenches 134 and 135 formed in the membrane 115. In detail, FIG. 6A illustrates that the trench 134 formed in the membrane 115 has a triangular sectional shape, and FIG. 6B illustrates that the trench 135 formed in the membrane 115 has a semicircular sectional shape. The sectional shape of a trench is not limited thereto, and the trench may have any of a variety of sectional shapes.

Figure 7A:
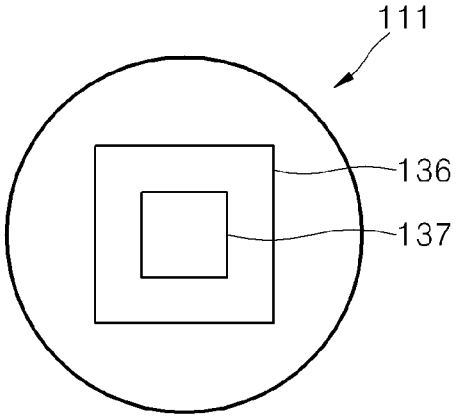
FIGS. 7A and 7B are plan views which illustrate modified plane shapes of the trench formed in the membrane.
Figure 7B:
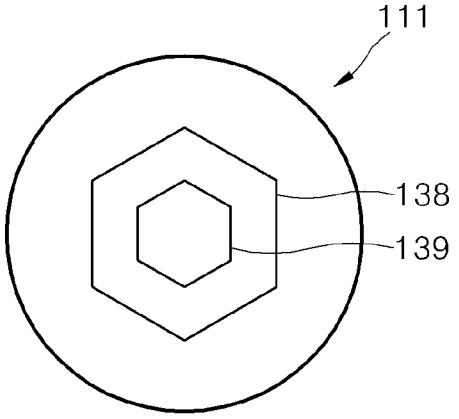

FIG. 2 illustrates that each of the trenches 131, 131', 132', 131", 132", and 133" formed in the membrane 115 has a circular plane shape. However, the present exemplary embodiment is not limited thereto, and the trenches 131, 131', 132', 131", 132", and 133" may have any one or more of a variety of plane shapes. The frequency characteristic of a cell may vary based on the plane shape of the trenches 131, 131', 132', 131", 132", and 133". FIGS. 7A and 7B are plan views illustrating modified plane shapes of trenches formed in the membrane 115. In detail, FIG. 7A illustrates that two trenches 136 and 137 are formed, and that each of trenches 136 and 137 has a rectangular plane shape. The number of trenches 136 and 137 may be variously modified. Further, the position and/or interval (i.e., relative spacing) of the trenches 136 and 137 may be variously modified. FIG. 7B illustrates that each of trenches 138 and 139 formed in the membrane 115 has a hexagonal plane shape. FIG. 7B illustrates that the trenches 138 and 139 are formed. The number of trenches 138 and 139 may be variously modified. Further, the position and/or the interval (i.e., relative spacing) of the trenches 138 and 139 may be variously modified. In addition, a trench having a different polygonal sectional shape or a different plane shape may be formed. Further, a trench may be formed at a center portion of the membrane 115. As described above, the cells 111 having different frequency characteristics may be manufactured by varying any one or more of the sectional shape, the plane shape, and/or the position of the trench formed in the membrane 115. In addition, the one element 110 having a broadband characteristic may be embodied by combining the cells 111 that are manufactured as above.

Figure 8:
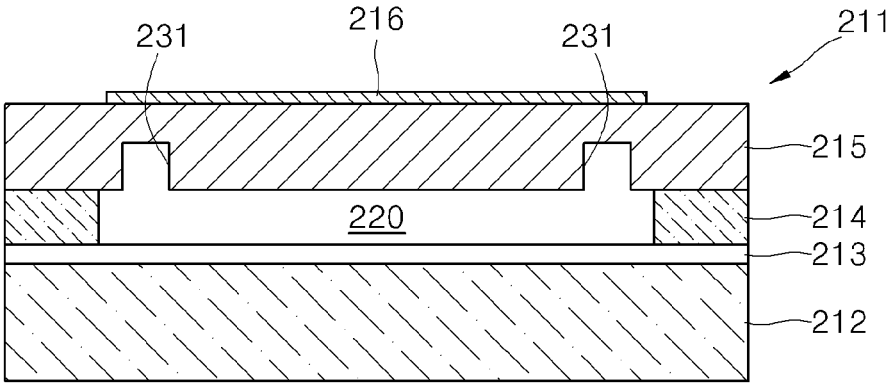
FIG. 8 is a cross-sectional view of a cell of an electro-acoustic transducer, according to another exemplary embodiment.

FIG. 8 is a cross-sectional view of a cell 211 of an electro-acoustic transducer, according another exemplary embodiment. FIG. 8 illustrates an example of only one cell 211 of cells 211 constituting one element for convenience of explanation. Referring to FIG. 8, the cell 211 includes a substrate 212, a support 214 provided on the substrate 212 and having a cavity 220 formed therein, a membrane 215 provided on the support 214 to cover the cavity 220, and an electrode 216 provided on an upper surface of the membrane 215. The substrate 212 may be formed of, for example, a conductive material such as low resistance silicon. An insulation layer 213 that is formed of, for example, silicon oxide, may be further formed on an upper surface of the substrate 212.

At least one of the cells 211 constituting the element of an electro-acoustic transducer according to the present exemplary embodiment includes a trench 231 formed in the membrane 215. In this case, at least two cells 211 of the cells 211 may include different numbers of trenches 231 as described above. Unlike the above-described exemplary embodiment, the trench 231 may be formed in a lower surface of the membrane 215. Although FIG. 8 illustrates that the trench 231 formed in the lower surface of the membrane 215 has a rectangular sectional shape, the trench 231 may have any one or more of a variety of sectional shapes, and any one or more of the number, the position, and the size of the trench 231 may be variously modified. As such, at least one of the cells 211 constituting the element may have a frequency characteristic which is different from those of the other cells 211 by varying at least one of the number, shape, size, and position of the trench 231 formed in the lower surface of the membrane 215. Accordingly, an element having a broadband frequency characteristic may be embodied by combining the cells 211.

Figure 9:
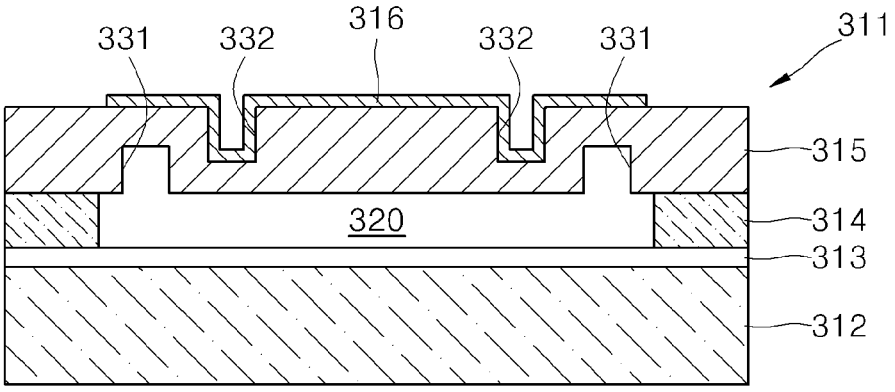
FIG. 9 is a cross-sectional view of a cell of an electro-acoustic transducer, according to another exemplary embodiment.

FIG. 9 is a cross-sectional view of a cell 311 of an electro-acoustic transducer, according another exemplary embodiment. FIG. 9 illustrates an example of only one cell 311 of the cells 311 constituting one element for convenience of explanation. Referring to FIG. 9, the cell 311 includes a substrate 312, a support 314 provided on the substrate 312 and having a cavity 320 formed therein, a membrane 315 provided on the support 314 to cover the cavity 320, and an electrode 316 provided on an upper surface of the membrane 315. The substrate 312 may be formed of, for example, a conductive material such as low resistance silicon. An insulation layer 313 that is formed of, for example, silicon oxide, may be further formed on an upper surface of the substrate 312.

At least one of the cells 311 constituting the element of an electro-acoustic transducer according to the present exemplary embodiment includes trenches 331 and 332 formed in the membrane 315. In this case, at least two cells 311 of the cells 311 may include different numbers of trenches as described above. Unlike the above-described exemplary embodiments, the trenches, for example, first and second trenches 331 and 332, are formed in lower and upper surfaces of the membrane 315, respectively. In detail, the first trench 331 is formed in the lower surface of the membrane 315, and the second trench 332 is formed in the upper surface of the membrane 315. Although FIG. 9 illustrates that each of the first and second trenches 331 and 332 has a rectangular sectional shape, the first and second trenches 331 and 332 may have any one or more of a variety of sectional shapes, and any one or more of the number, the position, and the size of the first and second trenches 331 and 332 may be variously modified. As such, at least one of the cells 311 constituting the element may have a frequency characteristic that is different from those of the other cells 311 by varying at least one of the number, shape, size, and position of the first and second trenches 331 and 332 formed in the lower and upper surfaces of the membrane 315, respectively. Accordingly, an element having a broadband frequency characteristic may be embodied by combining the cells 311.

Figure 10:
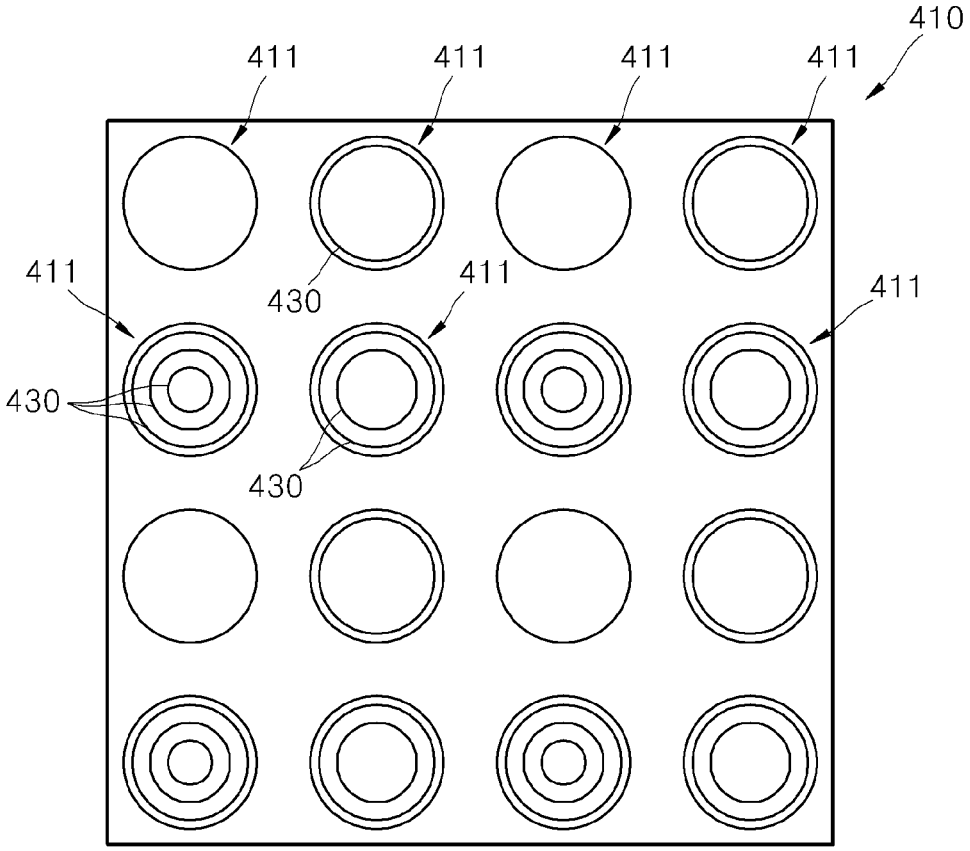
FIG. 10 is a plan view of an element of an electro-acoustic transducer, according to another exemplary embodiment.

Although the four cells, namely, the first, second, third, and fourth cells 111*a*, 111*b*, 111*c*, and 111*d*, constitute the element 110 according to the exemplary embodiment illustrated in FIG. 2, the number of cells constituting one element of an electro-acoustic transducer may be variously modified. FIG. 10 is a plan view of an element 410 of an electro-acoustic transducer, according another exemplary embodiment. Referring to FIG. 10, 16 cells 411 constituting one element 410 are arranged in a two-dimensional array. As described above, at least one of the cells 411 includes a trench 430 in order to embody the element 410 having a broadband frequency characteristic. In this case, at least two cells 411 of the 16 cells 411 may include different respective numbers of trenches 430. The positions of the cells 411 having different frequency characteristics may be variously modified. Although the cells 411 may have the same size, the present exemplary embodiment is not limited thereto. Although FIG. 10 illustrates that the 16 cells 411 are arranged in a square-shaped array, the number and arrangement of the cells 411 may be variously modified.

Figure 11A:
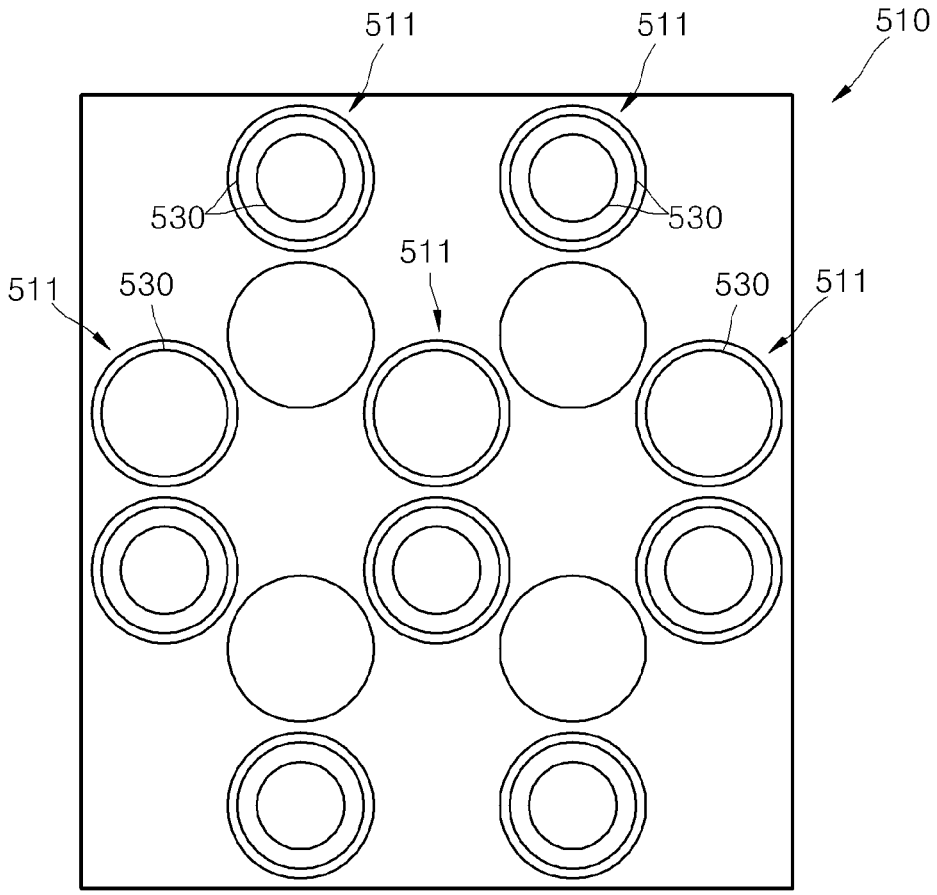
FIG. 11A is a plan view of an element of an electro-acoustic transducer, according to another exemplary embodiment.

FIG. 11A is a plan view of an element 510 of an electro-acoustic transducer, according another exemplary embodiment. Referring to FIG. 11A, a plurality of cells 511 constituting one element 510 are arranged in a two-dimensional array, and the cells 511 may be arranged hexagonally. As described above, in order to embody the element 510 having a broadband frequency characteristic, at least one of the cells 511 includes a trench 530. In this case, at least two cells 511 of the plurality of cells 511 may include different respective numbers of trenches 530. The positions of the cells 511 having different frequency characteristics may be variously modified. Although the cells 511 may have the same size, the present exemplary embodiment is not limited thereto.

Figure 11B:
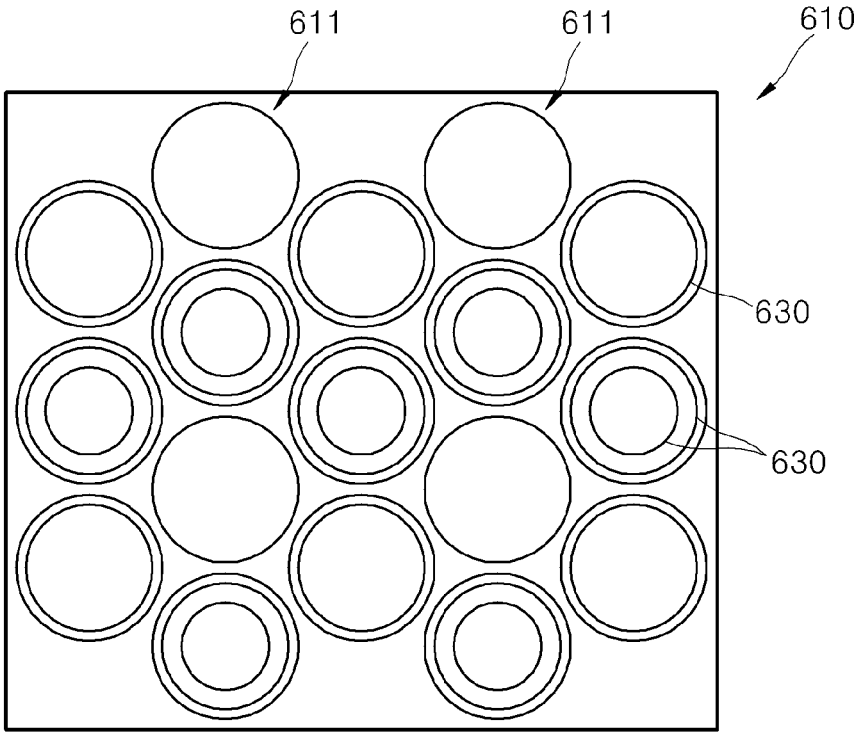
FIG. 11B is a plan view of an element of an electro-acoustic transducer, according to another exemplary embodiment.

FIG. 11B is a plan view of an element 610 of an electro-acoustic transducer, according another exemplary embodiment. Referring to FIG. 11B, a plurality of cells 611 constituting one element 610 are arranged in a two-dimensional array, and the cells 611 may be arranged hexagonally in a different manner than the hexagonal arrangement of FIG. 11A. In order to embody the element 610 having a broadband frequency characteristic, at least one of the cells 611 includes a trench 630. In this case, at least two cells 611 of the plurality of cells 611 may include different respective numbers of trenches 630. The positions of the cells 611 having different frequency characteristics may be variously modified. Although the cells 611 may have the same size, the present exemplary embodiment is not limited thereto. Although, in the above-described exemplary embodiments, the cells are arranged in a square-shaped array or in a hexagonally-shaped array, the cells may be arranged in any one or more of a variety of shapes.

As described above, in the electro-acoustic transducer according to the above exemplary embodiments, at least one of the cells constituting one element may include a trench which is formed in the membrane. The cells having different frequency characteristics may be manufactured by varying any one or more of the number, the size, the shape, and the position of the trenches formed in the membrane. Accordingly, an element having a broadband frequency characteristic may be embodied by combining the cells manufactured as above. The electro-acoustic transducer which includes the element having a broadband frequency characteristic may be applied to ultrasonic equipment that is configured for executing any one or more of various types of ultrasound signal acquisition methods which correspond to various types of images, such as a B-mode image, a Doppler image, a harmonic image, and a photoacoustic image, or to an ultrasonic equipment field which covers diagnoses of various organs having different sizes and depths, such as, for example, the abdomen, the heart, and the thyroid gland.

In the above descriptions, although the electro-acoustic transducer is described as an example of a capacitive micromachined electro-acoustic transducer, the electro-acoustic transducer may be applied to all types of electro-acoustic transducers in which a plurality of cells constitute one element and at least one of the cells includes a trench that is formed in a membrane.

It should be understood that the exemplary embodiments described herein should be considered in a descriptive sense only and not for purposes of limitation. Descriptions of features or aspects within each exemplary embodiment should typically be considered as available for other similar features or aspects in other embodiments.

While one or more exemplary embodiments have been described with reference to the figures, it will be understood by those of ordinary skill in the art that various changes in form and details may be made therein without departing from the spirit and scope of the present inventive concept as defined by the following claims.

What is claimed is:

1. An electro-acoustic transducer comprising a plurality of elements, wherein each of the plurality of elements comprises a plurality of cells of which at least one of the plurality of cells comprises a trench that is formed in a membrane, wherein each of the plurality of cells comprises:

a substrate;

a support provided on the substrate and comprising a cavity;

the membrane configured to cover the cavity; and an electrode provided on an upper surface of the membrane, wherein a height of the trench is less than a height of the membrane.

2. The electro-acoustic transducer of claim 1, wherein each of the plurality of elements has a first frequency band that is wider than a respective frequency band of each of the plurality of cells constituting the respective element.

3. The electro-acoustic transducer of claim 1, wherein for each of the plurality of elements, a frequency characteristic of the at least one of the plurality of cells that comprises the trench varies based on at least one from among a number, a shape, a size, and a position of the trench.

4. The electro-acoustic transducer of claim 1, wherein for each of the plurality of elements, at least two cells of the plurality of cells comprise different numbers of trenches.

5. The electro-acoustic transducer of claim 1, wherein for each of the plurality of elements, a plane shape of the trench comprises a polygon.

6. The electro-acoustic transducer of claim 1, wherein for each of the plurality of elements, a sectional shape of the trench comprises at least one from among a triangle, and a semicircle.

7. The electro-acoustic transducer of claim 1, wherein for each of the plurality of elements, the membrane comprises silicon.

8. The electro-acoustic transducer of claim 1, wherein each of the plurality of elements and each of the pluralities of cells is arranged in a respective two-dimensional arrangement.

9. The electro-acoustic transducer of claim 1, wherein for each of the plurality of elements, each of the plurality of cells has a same size.

10. An element of an electro-acoustic transducer, the element comprising:

a plurality of cells comprising a first cell and a second cell, wherein each of the first cell and the second cell has a same size, and wherein a frequency characteristic of the first cell is different from a frequency characteristic of the second cell, wherein each of the first cell and the second cell comprises a respective membrane, wherein the respective membrane comprises a trench that has a height less than a height of the membrane.

11. The element of claim 10, wherein the trench is formed in at least one from among an upper surface and a lower surface of the corresponding membrane.

12. The element of claim 11, wherein a frequency characteristic of the at least one from among the first cell and the second cell that comprises the trench varies based on at least one from among a number, a shape, a size, and a position of the trench.

13. The element of claim 11, wherein the first cell and the second cell comprise different numbers of trenches.

14. The element of claim 11, wherein a plane shape of the trench comprises at least one from among a circle and a polygon.

15. The element of claim 11, wherein a sectional shape of the trench comprises at least one from among a rectangle, a triangle, and a semicircle.

16. The element of claim 11, wherein the membrane comprises silicon.

17. The element of claim 10, wherein the element has a first frequency band that is wider than a respective frequency band of each of the plurality of cells constituting the element.

18. The element of claim 10, wherein the plurality of cells is arranged in a two-dimensional arrangement.

19. The element of claim 10, wherein each of the plurality of cells comprises:

a substrate;

a support provided on the substrate and comprising a cavity;

a membrane configured to cover the cavity; and an electrode provided on an upper surface of the membrane.

20. An electro-acoustic transducer comprising a plurality of elements, wherein each of the plurality of elements comprises a plurality of cells, and wherein, for each of the plurality of elements, each of the plurality of cells comprises:

a substrate;

a support provided on the substrate and comprising a cavity;

a membrane configured to cover the cavity; and an electrode provided on an upper surface of the membrane, and wherein, for each of the plurality of elements, at least one of the plurality of cells comprises a trench that is formed in the membrane, wherein a height of the trench is less than a height of the membrane.

* * * * *